US005210951A

United States Patent [19]

Chen

[11] Patent Number: 5,210,951

[45] Date of Patent: May 18, 1993

[54] TRISECTOR

[76] Inventor: Fen Chen, P.O. Box 16707, Alexandria, Va. 22302

[21] Appl. No.: 934,279

[22] Filed: Aug. 25, 1992

[51] Int. Cl.[5] ..... B43L 9/08

[52] U.S. Cl. ..... 33/1 AP

[58] Field of Search ..... 33/1 AP

[56] References Cited

U.S. PATENT DOCUMENTS 2,222,853 11/1940 Neurohr ..... 33/1 AP
3,906,638 9/1973 Romano ..... 33/1 AP

FOREIGN PATENT DOCUMENTS 56135 7/1890 Austria ..... 33/1 AP
41541 7/1909 Austria ..... 33/1 AP
492112 6/1919 France ..... 33/1 AP

OTHER PUBLICATIONS

Yates, "The Trisection Problem", 1942, pp. 7-9, 29-30, 42-44.

Washington Post, Section II, p. 1, Jan. 6, 1948, "D.C. Man Invents Device to Trisect Angle Easily".

*Primary Examiner*—William A. Cuchlinski, Jr.
*Assistant Examiner*—Alvin Wirthlin

[57] ABSTRACT

An instrument for trisecting an angle has two circular plates and four pointers. Two pointers are to define a given angle which can be an acute angle or obtuse angle. Two other pointers are to divide the given angle into three equal angles when they are perpendicular each other.

3 Claims, 5 Drawing Sheets

TRISECTOR

BACKGROUND OF THE INVENTION

1. Field of the Invention

The application for Utility Patent of the Trisector is to link with the Disclosure Document No. 200810 on the Mar. 2, 1992. The Utility Patent is to describe or protect the character, function, and operation of the new trisector.

2. Description of the Prior Art

For centuries, in the history of Euclidean Geometry, we could divide any angle into two equal angles easily, but, we had a very difficult time dividing an angle into three equal angles. This problem has persisted for over two thousand years.

Originally, as shown in FIG. 1, Archimedes(ca. 287–212 B.C.) constructed the problem by taking as the center apex S of the angle ASB to be trisected. The process is to draw a circle of a radius r on the edge of a paper strip and placing the edge on the point B. In such manner that it passes through B and the end point on the circle with the other point Q(outside of the circle) of the extension of AS, then the angle PQS is one third of the given angle ASB. Obviously, the trisection process was unable to define the point P exactly. The invention is not to define the point P directly, it is to define the M first (FIG. 2). Here, the point M is the middle point of QS, and PM must perpendicular to QS. The new discovery is to discuss how to define the point M. Consequently, we can define the point P and Q because triangle PQS and triangle PSB are issoceles triangles. Thus, the point P is on the line of perpendicularity of line QS. Similary, the point S is on the line of perpendicularity and bisecting PB as shown in FIG. 2.

SUMMARY

The invention is a new instrument to find an angle equal to one-third of a given angle. The main body of the trisector has two equal circular plates and four pointers. The four pointers are not joined at the same rotating point. One pointer is integral to the body of one of the plates. The other three pointers can be rotated at the two centers of the circular plates. Two pointers can be used to define a given angle of the measurement between 0 and 180. The other two pointers can be used to find the one-third of the given angle when two of the pointers are perpendicular each other.

DETAILED DESCRIPTION

Figure 1:
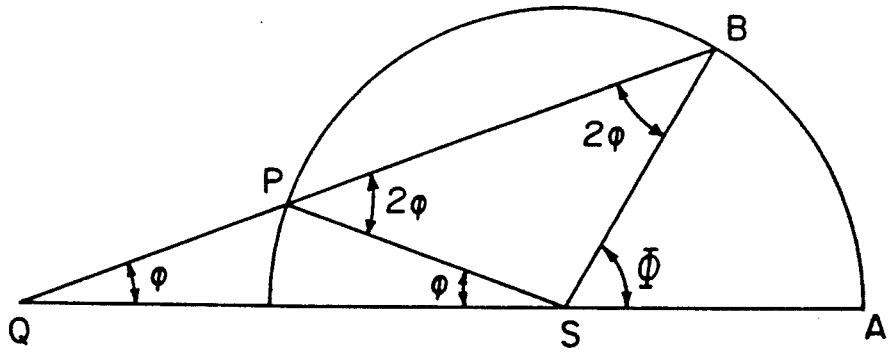
FIG. 1 (PRIOR ART)
FIG. 1 is a prior art method for determining the trisection of an angle.
Figure 2:
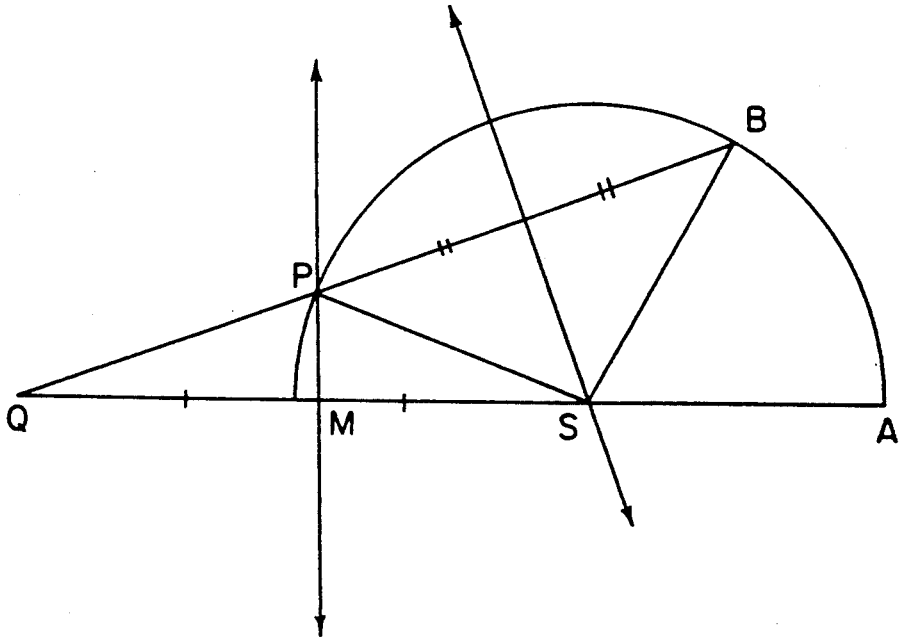
FIG. 2 is the new method according to the invention for determining the trisection of an angle.
Figure 3:
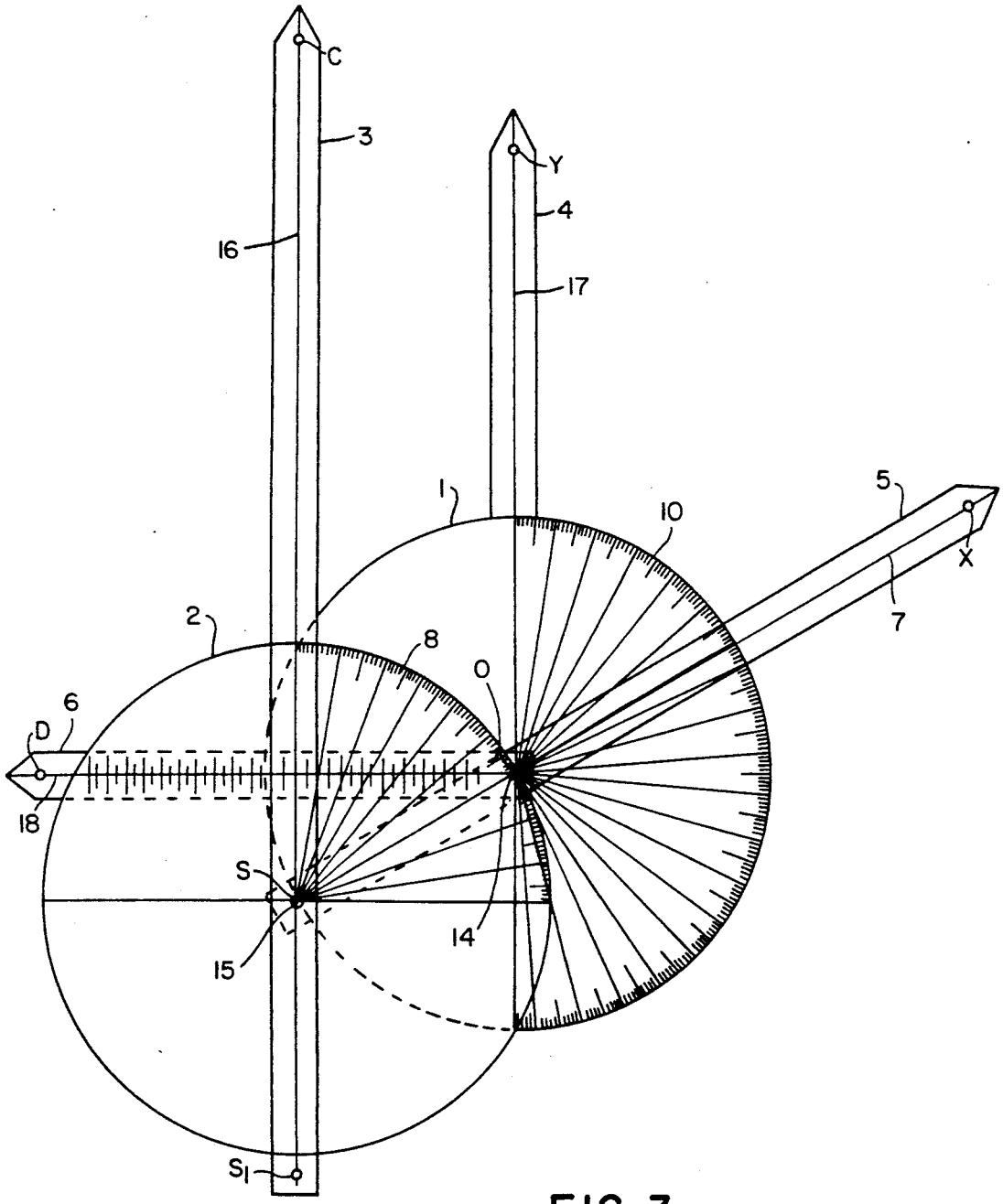
FIG. 3 is a plan view of an embodiment for using the method of the present invention.
Figure 4:
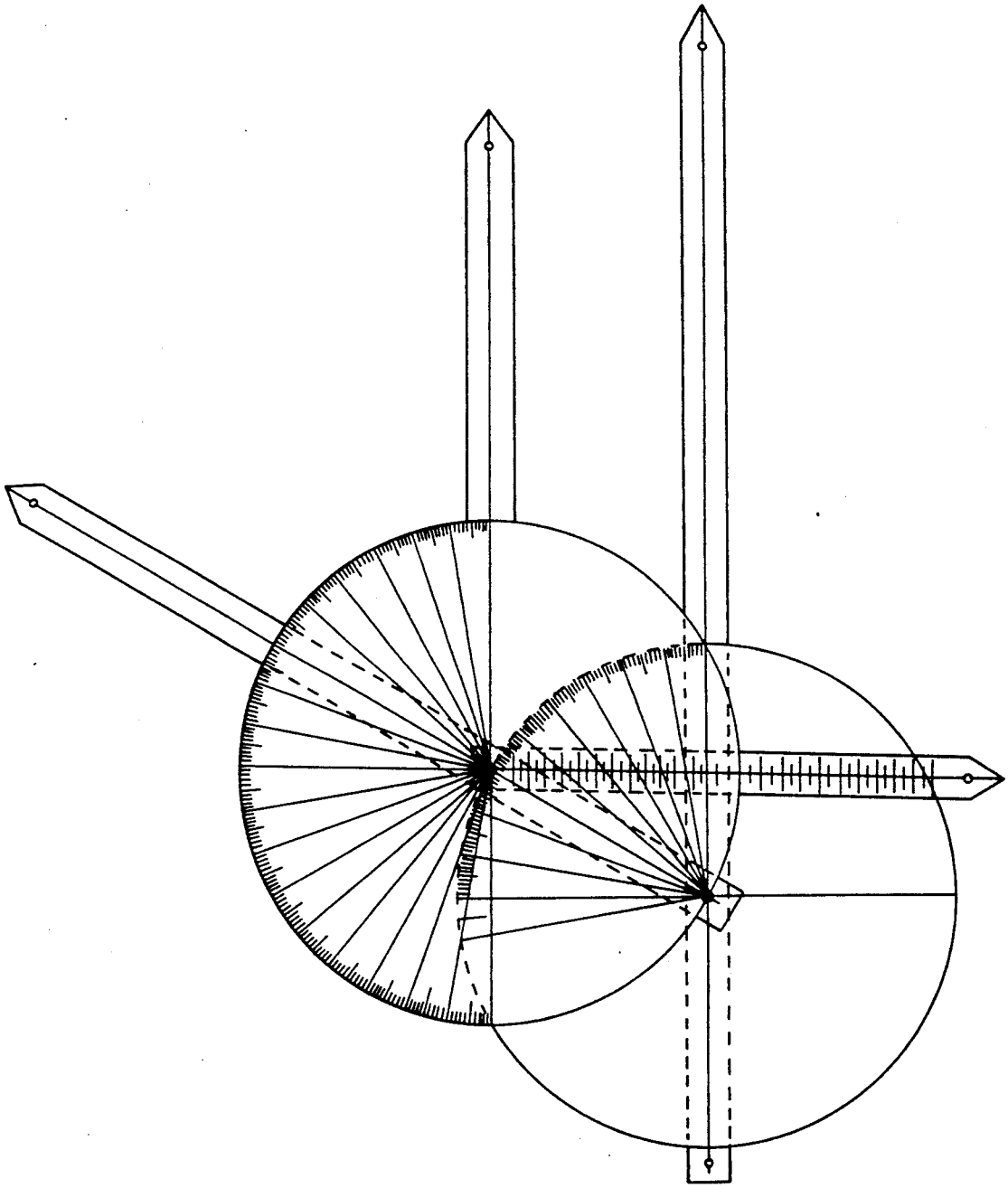
FIG. 4 is a bottom view of the instrument.
Figure 5:
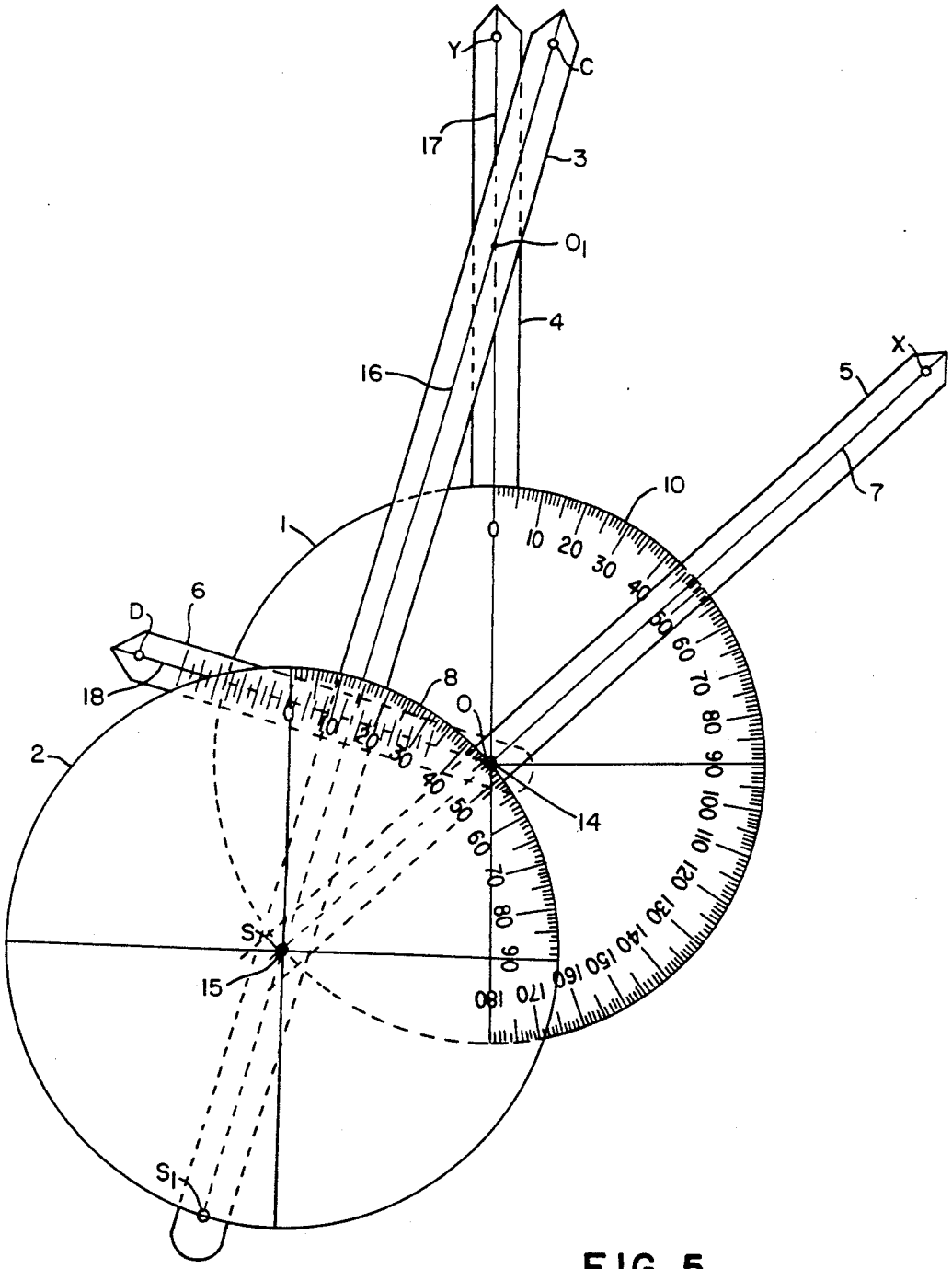
FIG. 5 shows the instrument in use for finding the trisection of an angle.

The trisector according to the present invention as seen in FIGS. 3–5 comprises a first circular plate 1 and a second circular plate 2 of equal diameter and four elongated pointers 3, 4, 5, and 6.

The pointer 4 would be integrated into the body of the circular plate 1. The reference means 17 or OY in the central part of the point 4 is to reference the vertical Y-axis on a coordinated plane for defining on one side of a given angle XOY. The numeral 10 is a protractor of the circular plate 1, the degrees from 0 to 180 for defining a given angle XOY.

The pointer 3 is rotated about the center 15 or the point S of the circular plate 2 to meet the point 4 for trisecting an angle XOY. At the same time, the pointer 6 is rotated about the center 14 or the point O of the circular plate 1 to meet the pointer 3 and to permit the reference means 18 or OD in the pointer 6 and the reference means 16 or SC or $S_1SC$ in the pointer 3 to be adjusted perpendicular to each other. The acute angle $OO_1S$ would be one-third of the given angle XOY. The point $O_1$ is the intersecting point of the reference means 16 and 17.

Figure 6:
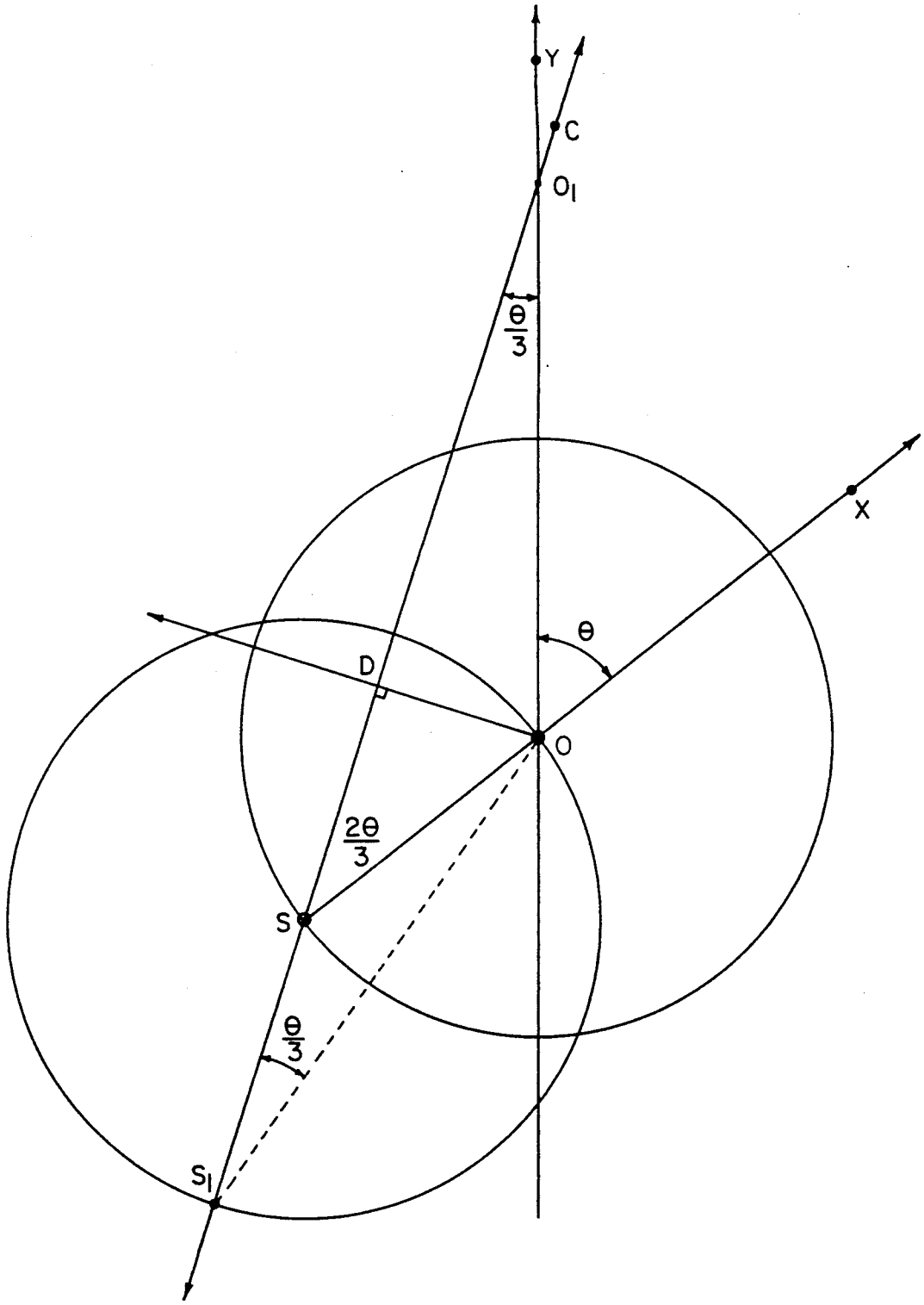
FIG. 6 is a simplified representation of FIG. 5.

In order to find the measurement of the angle $OO_1S$, the numeral 8 is a protractor of the circular plate 2, having degrees ranging from 0 to 90 for indicating the angle $OS_1S$ on the FIG. 6 which is one third the angle XOY, through the intersection of reference means 16 and protractor 8.

I claim:

1. A trisecting instrument for trisecting an angle having two circular-shaped members of equal diameter; said two plates are rotatably connected by a long first pointer at the centers of the two circular plates; such that the centers of said first and second plates rotate about the circumference of said second and first plates respectively; said first pointer defining one side of said angle; a second pointer rotatably connected to the center of the second plate, a third pointer rotatably connected to the center of the first plate; and reference means for defining the other side of said angle.

2. The instrument of claim 1 wherein said first and second plates have graduated markings thereon for determining said trisection.

3. The instrument of claim 1 wherein said reference means comprises a fourth pointer fixed to said first plate.

* * * * *